US010385693B2

(12) United States Patent
Batllo et al.

(10) Patent No.: US 10,385,693 B2
(45) Date of Patent: Aug. 20, 2019

(54) AIR MOTOR AND PUMP COMPRISING SUCH A MOTOR

(71) Applicant: EXEL INDUSTRIES, Epernay (FR)

(72) Inventors: Benoit Batllo, Fontenay Prés Chablis (FR); Boussif Khaldi, Arnouville (FR)

(73) Assignee: EXEL INDUSTRIES, Epernay (FR)

( * ) Notice: Subject to any disclaimer, the term of this patent is extended or adjusted under 35 U.S.C. 154(b) by 124 days.

(21) Appl. No.: 15/539,019

(22) PCT Filed: Dec. 24, 2015

(86) PCT No.: PCT/EP2015/081228
§ 371 (c)(1),
(2) Date: Jun. 22, 2017

(87) PCT Pub. No.: WO2016/102704
PCT Pub. Date: Jun. 30, 2016

(65) Prior Publication Data

US 2017/0350247 A1 Dec. 7, 2017

(30) Foreign Application Priority Data

Dec. 26, 2014 (FR) ..... 14 63354

(51) Int. Cl.
*F01B 11/00* (2006.01)
*F01L 23/00* (2006.01)
(Continued)

(52) U.S. Cl.
CPC ..... *F01B 11/001* (2013.01); *F01B 17/025* (2013.01); *F01L 21/00* (2013.01);
(Continued)

(58) Field of Classification Search
CPC .... F01L 23/00; F15B 9/08; F15B 9/12; F15B 13/0401; F15B 13/0405
See application file for complete search history.

(56) References Cited

U.S. PATENT DOCUMENTS 488,763 A * 12/1892 Hultgren ..... F01L 29/04 91/20
513,601 A * 1/1894 Teal ..... F15B 9/08 91/47
(Continued)

FOREIGN PATENT DOCUMENTS

DE 1992789 U 8/1968
DE 2816617 A1 10/1979
(Continued)

OTHER PUBLICATIONS

Search report issued for French patent application No. 1463354, dated Nov. 11, 2015, 2 pages.
(Continued)

*Primary Examiner* — Nathaniel E Wiehe
*Assistant Examiner* — Matthew Wiblin
(74) *Attorney, Agent, or Firm* — Duane Morris LLP

(57) ABSTRACT

The present invention concerns an air motor comprising a piston and a housing, the piston being received in the housing and dividing the housing into two primary chambers of variable volume. Said motor comprises a first direct supply valve for supplying a first primary chamber of the two primary chambers and a second direct supply valve for supplying the other primary chamber, said two valves each being movable relative to at least one respective seat. The first valve and the second valve are mounted on a same stem movable relative to the housing in a direction parallel to the direction of movement of the piston, and the stem is configured to be moved between a first position and a second position by moving means activated by the piston.

9 Claims, 6 Drawing Sheets

(51) Int. Cl.

| | |
|---|---|
| ***F01L 21/00*** | (2006.01) |
| ***F01B 17/02*** | (2006.01) |
| ***F01L 21/04*** | (2006.01) |
| ***F04B 7/06*** | (2006.01) |
| *F02B 23/08* | (2006.01) |
| *F01L 3/00* | (2006.01) |
| *F04B 53/14* | (2006.01) |

(52) U.S. Cl.
CPC ..... *F01L 21/04* (2013.01); *F01L 23/00* (2013.01); *F04B 7/06* (2013.01); *F01L 2003/25* (2013.01); *F02B 23/08* (2013.01); *F04B 53/143* (2013.01)

(56) References Cited

U.S. PATENT DOCUMENTS

| | | | | | |
|---|---|---|---|---|---|
| 791,368 | A | * | 5/1905 | Reynolds | F01L 23/00 184/83 |
| 4,240,329 | A | * | 12/1980 | Inhofer | F01L 23/00 91/342 |
| 4,325,285 | A | * | 4/1982 | Roser | F01B 11/001 91/341 R |
| 4,974,495 | A | * | 12/1990 | Richeson, Jr. | F01L 9/02 123/90.11 |
| 5,012,643 | A | * | 5/1991 | Higami | F01B 17/02 251/65 |

FOREIGN PATENT DOCUMENTS

| | | | | | |
|---|---|---|---|---|---|
| DE | 2823667 | A1 | | 12/1979 | |
| EP | 0319341 | A2 | | 6/1989 | |
| EP | 0414268 | A1 | | 2/1991 | |
| FR | 484199 | A | * | 9/1917 | F01L 23/00 |
| FR | 2513311 | A | * | 3/1983 | F01B 19/02 |
| FR | 2695965 | A1 | | 3/1994 | |
| WO | 03/058072 | A2 | | 7/2003 | |

OTHER PUBLICATIONS

International Search Report issued for International patent application No. PCT/EP2015/081228, dated Mar. 22, 2016, 6 pages.

* cited by examiner

AIR MOTOR AND PUMP COMPRISING SUCH A MOTOR

CROSS-REFERENCE TO RELATED APPLICATIONS

The present application is a United States national stage application under 35 U.S.C. § 371 of international patent application number PCT/EP2015/081228, filed Dec. 24, 2015, which claims priority to French patent application no. 1463354, filed Dec. 26, 2014, the entireties of which are incorporated herein by reference.

BACKGROUND OF THE INVENTION

The present invention relates to a compressed air motor comprising a piston and a housing, the piston being received in the housing and dividing the housing into two primary chambers of variable volume.

Compressed air motors are frequently used to drive alternating movement pumps. Such pumps are in particular used to pumps viscous products, such as putty, or liquid products, such as paint. Document FR 2,695,965 A1 describes one such pump comprising a compressed air motor.

Compressed air motors generally comprise a housing containing a piston. The piston divides the housing into two chambers, commonly called "upper chamber" and "lower chamber", which are alternately supplied with compressed air. The alternating injection of compressed air into each of the chambers generates the alternating movement of the piston.

Compressed air motors are frequently equipped with a distributor, which alternately supplies the upper chamber and the lower chamber. The distributor is generally controlled by external control members, of the switch type. Such motors are very reliable, but expensive. Furthermore, the use of distribution and external control members makes the assembly and maintenance of an installation comprising such a motor more complex.

Other types of motors are equipped with an integrated inverter block including a rotary spring. These motors have a simple design, but have reliability problems.

Other types of compressed air motors do not require an inverter or distributors. A compressed air motor is for example known from document FR 484,199 A comprising two distributors supplying the upper and lower chambers supported by a same stem. The stem is moved by the piston between two positions to control the supply of the chambers.

Document DE 19 92 789 U describes a compressed air motor in which two seals supported by a stem control the supply of the upper and lower chambers.

Several examples of compressed air motors in which the supply of the upper and lower chambers is controlled by two valves mounted on a same stem are known from document EP 0,414,268 A1, DE 28 16 617 A1, DE 28 23 667 A1 and EP 0,319,341 A2.

Another type of compressed air motor in which the alternating supply of the chambers is obtained by the movement of a stem is described in document WO 2003/058072 A2.

However, these known compressed air motors often have reliability problems, since in a case where the control stem is stopped in an intermediate position, the two chambers could be supplied at the same time and the motor would then remain blocked. Mechanisms making it possible to keep the stem in its extreme positions exist, but make the structure of the motor more complex.

Other mechanisms for controlling the supply of the upper and lower chambers of a motor cylinder are known. For example, a valve actuator in which a moving sleeve commands the supply of the upper and lower chambers of a cylinder is known from document U.S. Pat. No. 4,974,495 A.

SUMMARY OF THE INVENTION

The aim of the invention is to propose a reliable compressed air motor having a simple structure, and not requiring an external control member for the supply of its chambers with compressed air.

To that end, the invention relates to a compressed air motor of the aforementioned type, which comprises a first direct supply valve for supplying a first primary chamber of the two primary chambers and a second direct supply valve for supplying the other primary chamber, these two valves each being movable relative to at least one respective seat. The first valve and the second valve are mounted on a same stem movable relative to the housing in a direction parallel to the direction of movement of the piston. The stem is configured to be moved between a first position and a second position by moving means activated by the piston.

According to other advantageous aspects of the invention, the motor comprises one or more of the following features, considered alone or according to all technically possible combinations:

- the moving means are activated by the piston when it reaches the upper neutral position or the lower neutral position of its trajectory;
- the moving means are elastic means;
- the elastic means comprise at least one spring.
- the stem bears at least one pin, the spring being wound around the stem and able to exert a force on the pin moving the stem from its second position toward its first position, or vice versa.
- the moving means comprise at least a first moving magnet and a second moving magnet exerting a magnetic repulsion force on one another.
- the piston is movable relative to the housing along a primary direction and the stem extends in the primary direction through a first primary chamber, the piston and a second primary chamber.
- the motor further comprises means for keeping the stem in at least one of its first and second positions.
- the first and second valves are made at least partially from a ferromagnetic material, and in that the maintaining means comprise at least a first maintaining magnet able to exert a first retaining force on the first valve, a second maintaining magnet able to exert a second retaining force on the first valve, a third maintaining magnet able to exert a third retaining force on the second valve and a fourth maintaining magnet able to exert a fourth retaining force on the second valve.
- the housing comprises a first secondary chamber having a first intake seat and a first discharge seat and a second secondary chamber having a second intake seat and a second discharge seat, the first valve being received in the first secondary chamber and the second valve being received in the second secondary chamber, the first valve bears on the first discharge seat and the second valve bears on the second intake seat, when the stem is in its first position and the first valve is bearing on the first intake seat and the second valve is bearing on the second discharge seat, when the stem is in its second position.

the housing includes at least one cylinder head, and the stem includes at least one bearing sliding sealably in the cylinder head.

The invention also relates to a pump with alternating movement comprising a motor as previously described.

BRIEF DESCRIPTION OF THE DRAWINGS

The features and advantages of the invention will appear upon reading the following description, provided solely as a non-limiting example, and done in reference to the appended drawings, in which.

DETAILED DESCRIPTION OF PREFERRED EMBODIMENTS

Figure 1:
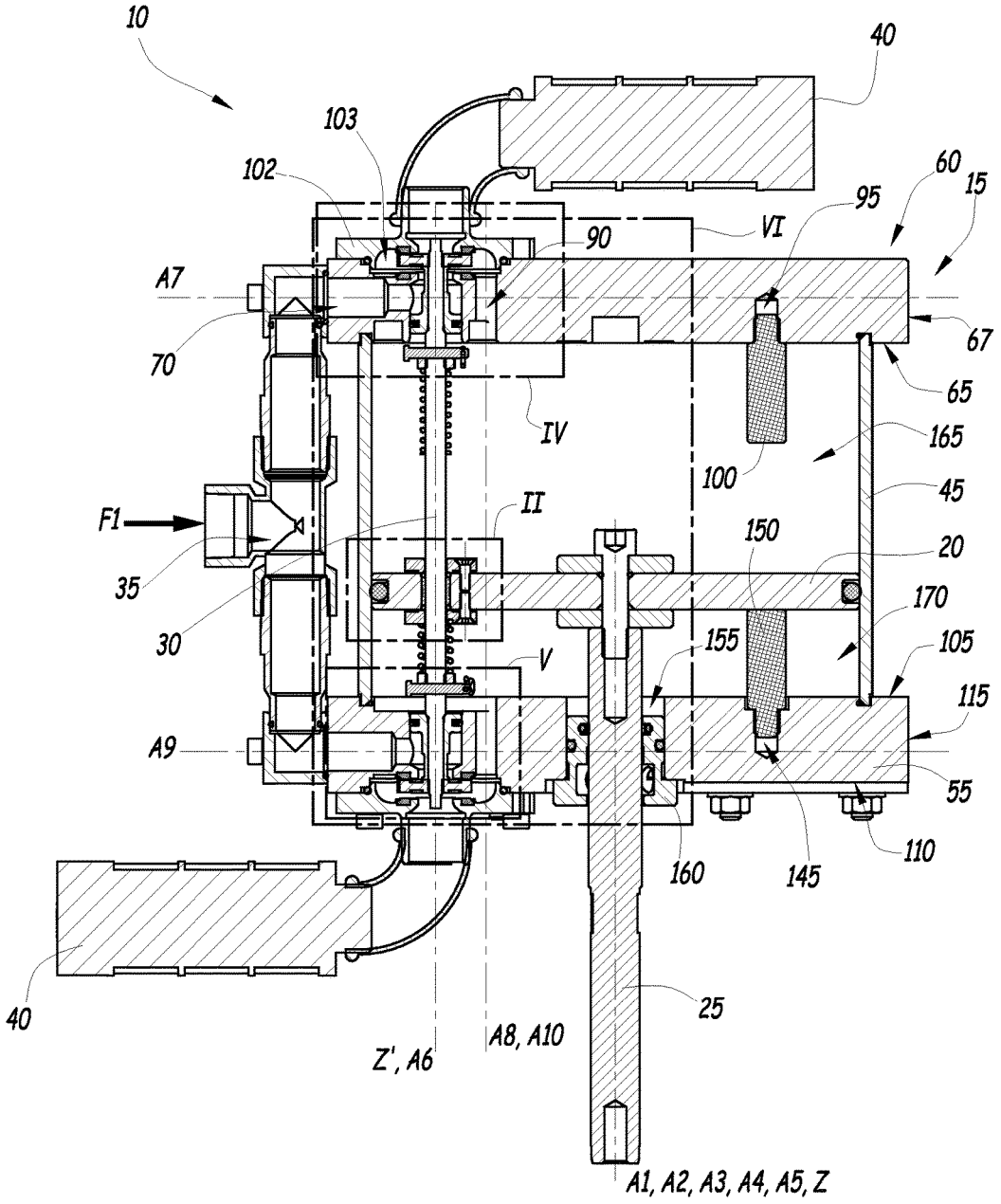
FIG. 1 is a longitudinal sectional view of a compressed air motor according to the invention.
Figure 2:
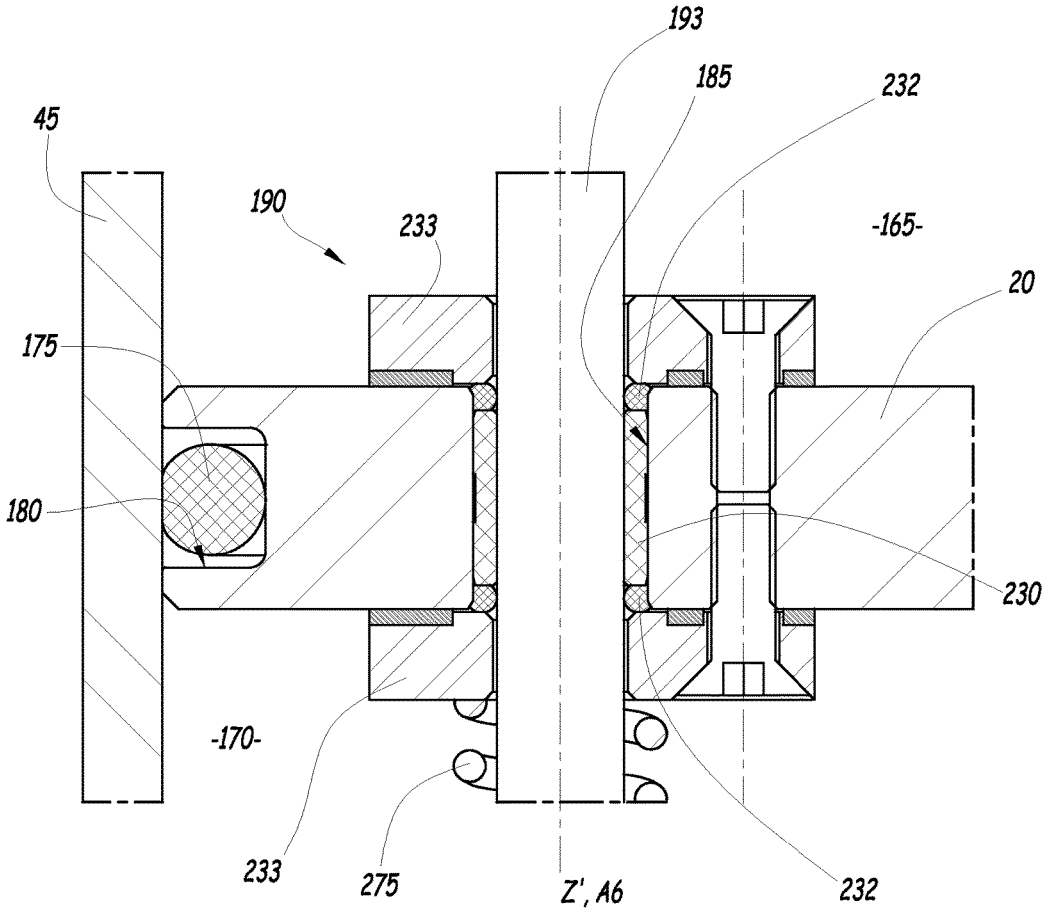
FIG. 2 is an enlarged view of detail II in FIG. 1.
Figure 3:
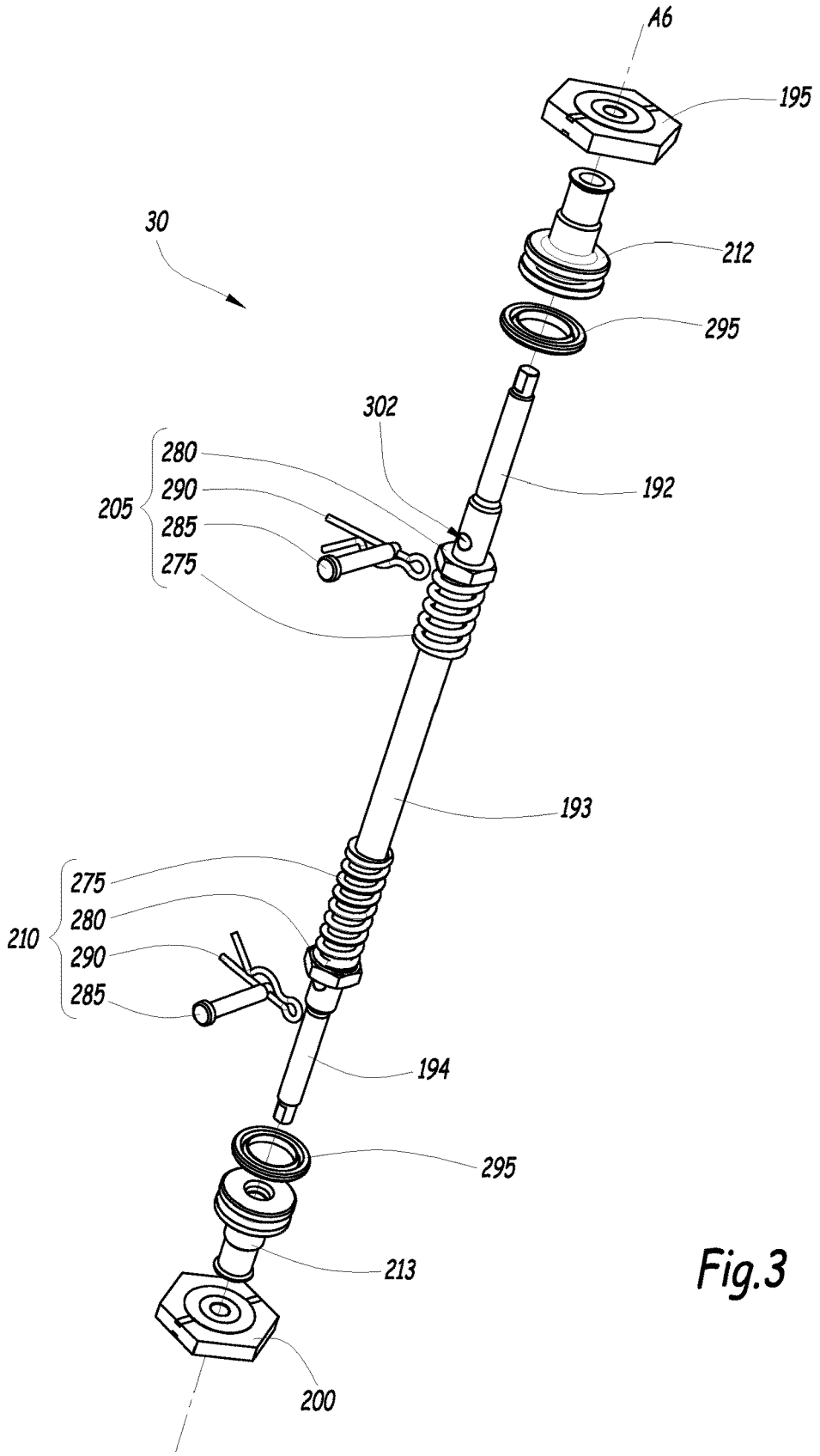
FIG. 3 is an exploded perspective view of a stem of the motor of FIGS. 1 and 2 and members that equip it.

A pump 6 with alternating movement includes a pumping stage 8 and a compressed air motor 10.

The pumping stage 8 is able to drive a fluid, such as a coating product, a putty or a glue. The pumping stage 8 is actuated by the motor 10.

A first example pump 6 is shown in FIGS. 1 to 7.

The compressed air motor 10 includes a housing 15, a piston 20 secured to a force transmitting shaft 25, a reversing stem 30, a supply tube 35 and two silencers 40.

The housing 15 comprises a side wall 45, a first cylinder head 50 and a second cylinder head 55.

The side wall 45 is cylindrical and centered on a first axis A1, for example with a circular base.

The first axis A1 is oriented along a primary direction Z of the motor 10.

The side wall 45 is made from a metal material. For example, the side wall 45 is made from aluminum. Alternatively, the side wall 45 is made from a composite or synthetic material.

The first cylinder head 50 and the second cylinder head 55 are provided to be fastened to the side wall 55 to form the housing 15.

The first cylinder head 50 comprises a first supply duct 70, a first internal opening for the putty, a first cavity 80, a first external opening 85, a first connecting duct 90 and a first tapping 95 for screwing a threaded stop 100. The first cylinder head 50 also bears a first end block 102 defining a first secondary chamber 103.

The first cylinder head 50 is cylindrical with a circular base and centered around a second axis A2. The second axis A2 is combined with the first axis A1.

Along the primary direction Z, the first cylinder head 50 is defined by a first outer face 60 and a first inner face 65. The first inner face 65 is oriented toward the second cylinder head 55. The first cylinder head 50 further has a first side face 67.

The second cylinder head 55 is cylindrical with a circular base and centered around a third axis A3. Preferably, the third axis A3 is combined with the first axis A1.

Along the primary direction Z, the second cylinder head 55 is defined by a second inner face 105 and a second outer face 110. The second inner face 105 is oriented toward the first cylinder head 50. The second cylinder head 55 further has a second side face 115.

The first and second cylinder heads 50 and 55 are made from a metal material, for example aluminum.

The second cylinder head 55 comprises a second supply duct 120, a second internal opening 125, a second cavity 130, a second external opening 135, a second connecting duct 140 and a second threaded receiving hole 145, for receiving a second screwed stop 150. The second cylinder head 55 also bears a second end block 152 defining a second secondary chamber 153.

The second cylinder head 55 further comprises a first through hole 155 for receiving the shaft 25 and a first primary bearing 160 positioned around the shaft 25 and in which this shaft 25 slides when the motor 10 is operating.

The piston 20 is cylindrical and centered on a fourth axis A4. The fourth axis A4 is preferably combined with the first axis A1.

Preferably, the piston 20 is cylindrical with a circular base.

The piston 20 is able to separate the housing 15 into an upper primary chamber 165, or first primary chamber, and a lower primary chamber 170, or second primary chamber.

The piston 20 is translatable relative to the housing 15, along the direction Z, between an upper neutral position and a lower neutral position. The piston 20 is translatable along the primary direction Z.

The piston 20 is made from a metal material, preferably aluminum.

The piston 20 includes a peripheral receiving groove 180 for receiving a piston seal 175, a passage opening 185 for the stem 30 and sealing means 190 for the opening 185.

The piston 20 is fastened to the shaft 25 using a screw 252 engaged in an axial tapping 254 of the shaft 25. The screw 252 traverses a screw orifice 202 arranged at the center of the piston and centered on the axis A4. Two washers 256 and 258, respectively positioned in the first primary chamber 165 and in the second primary chamber 170, are axially tightened around the orifice 202 by the screw 252 and the shaft 25.

One end of the shaft 25, opposite the piston 20, is coupled to the pumping stage 8.

The shaft 25 is cylindrical and centered on a fifth axis A5, combined with the first axis A1. The shaft 25 is received in the primary bearing 160. The shaft 25 is translatable, with the piston 20, along the primary direction Z. The reversing stem 30 has a first end part 192, a central part 193 and a second end part 194 opposite the first end part 192.

The reversing stem 30 bears a first valve 195, a second valve 200, first movement means 205, second movement means 210, a first bearing 212 (sometimes called "coil") and a second bearing 213.

The reversing stem 30 has a cylindrical symmetry around a sixth axis A6, parallel to the first axis A1 and radially offset relative thereto. The reversing stem 30 is made from a metal material, preferably steel.

The reversing stem 30 extends, along the primary direction Z, through the first secondary chamber 103, the first external opening 85, the first internal opening 75, the upper primary chamber 165, the piston 20, the lower primary chamber 170, the second internal opening 125, the second outer opening 135 and the second secondary chamber 153.

The reversing stem 30 is translatable, along a secondary direction Z', relative to the housing 15. The secondary direction Z' is parallel to the primary direction Z.

The reversing stem 30 is movable between a first position, in which the first valve 195 closes off the first external opening 85, and a second position, in which the second valve 200 closes off the second external opening 135.

The supply tube 35 is able to guide a stream of compressed air F1 arriving from a compressor, not shown, and to deliver this pressurized stream of air F1 simultaneously to the first supply duct 70 and the second supply duct 120.

The supply tube 35 is for example made from a composite material. Alternatively, the supply tube 35 is made from a metal, for example aluminum.

The first supply duct 70 is able to receive the compressed air stream F1 from the supply tube 35, and to deliver the compressed air stream to the first internal opening 75.

The first supply duct 70 has a cylindrical symmetry around a seventh axis A7, perpendicular to the first axis A1. Along the seventh axis A7, the first supply duct 70 is defined by the first side face 67 and by the first internal opening 75.

The first internal opening 75 is cylindrical with a circular base. The central axis of the first internal opening 75 is the sixth axis A6.

Along the primary direction Z, the first internal opening 75 is defined by the first inner face 65 and by a first frustoconical wall 215.

The first cavity 80 is arranged in the first outer face 60. The first cavity 80 is cylindrical with a circular base. The central axis of the first cavity 80 is the sixth axis A6. A first intake seat 220, traversed by the first external opening 85, and first maintaining means 225 are positioned in the first cavity 80.

The first cavity 80 is closed off by the first end block 102, which is fastened on the first external face 60, for example by screws. The first end block 102 is preferably made from metal, for example aluminum. The first end block 102 further bears a silencer 40. The first cavity 80 and the first end block 102 together define the first secondary chamber 103.

The first external opening 85 extends between the first frustoconical wall 215 and the first cavity 80.

The first external opening 85 has a cylindrical symmetry around the sixth axis A6. For example, the first external opening 85 is cylindrical with a circular base.

The first connecting duct 90 extends between the first cavity 80 and the first inner face 65.

The first connecting duct 90 is cylindrical with a circular base and centered around an eighth axis A8, parallel to the first axis A1 and radially offset relative thereto. The first connecting duct 90 is able to allow the passage of compressed air between the first secondary chamber 103 and the upper primary chamber 165, and vice versa.

The first stop 100 is configured so that the piston 20 bears on this stop, when the piston 20 is in the upper neutral position of its trajectory. The stop 100 is for example made from a synthetic material.

The first end block 102 comprises a first discharge opening 235 and a first discharge seat 240 surrounding the first discharge opening 235. The first end block 102 further comprises second maintaining means 242.

The second supply duct 120 is able to receive the compressed air stream F1 from the supply tube 35, and to deliver the compressed air stream to the second internal opening 125.

The second supply duct 120 has a cylindrical symmetry around a ninth axis A9. The ninth axis A9 is perpendicular to the first axis A1. Along the ninth axis A9, the second supply duct 120 is defined by the second side face 115 and by the second internal opening 125.

The second internal opening 125 is cylindrical with a circular base. The central axis of the second internal opening 125 is the sixth axis A6.

Along the primary direction Z, the second internal opening 125 is defined by the second inner face 105 and by a second frustoconical wall 245.

The second cavity 130 is arranged in the second outer face 110.

The second cavity 130 is cylindrical with a circular base. The central axis of the second cavity 130 is the sixth axis A6.

A second intake seat 250, traversed by the second external opening 135, and third maintaining means 255 are positioned in the second cavity 130.

The second cavity 130 is closed off by the second end block 152, which is fastened on the second external face 110, for example by screws. The second end block 152 is preferably made from metal, for example aluminum. The second end block 152 further bears a silencer 40. The second cavity 130 and the second end block 152 together define a second secondary chamber 153.

The second external opening 135 extends between the second frustoconical wall 245 and the second cavity 130.

The second cavity 130 has a cylindrical symmetry around the sixth axis A6. For example, the second cavity 130 is cylindrical with a circular base.

The second connecting duct 140 extends between the second cavity 130 and the second inner face 105.

For example, the second connecting duct 140 is cylindrical with a circular base and centered around a tenth axis A10, parallel to the first axis A1. The tenth axis A10 is combined with the eighth axis A8. The second connecting duct 140 is able to allow the passage of compressed air between the first secondary chamber 153 and the lower primary chamber 170, and vice versa.

The second stop 150 is configured so that the piston 20 bears on this stop, when the piston 20 is in the lower neutral position of its trajectory. The second stop screw 150 is for example made from a synthetic material.

The second end block 152 comprises a second discharge opening 265 and a second discharge seat 270 surrounding the second discharge opening 265. The second end block 152 further comprises fourth maintaining means 272.

The first through hole 155 extends between the second inner face 105 and the second outer face 110.

The first through hole 155 is cylindrical with a circular base. The central axis of the first through hole 155 is the first axis A1.

The first through hole 155 receives the first primary bearing 160 able to allow the shaft 25 to translate along the primary direction Z. The first primary bearing 160 is further capable of preventing the passage of compressed air between the second primary chamber 170 and the outside of the housing 15.

The piston seal 175 is capable of preventing the passage of compressed air between the upper primary chamber 165 and the lower primary chamber 170 at the side wall 45. The piston seal 175 is for example an O-ring made from a synthetic material.

The passage opening 185 receives the central part 193 of the reversing stem 30. The passage opening 185 of the reversing stem 30 is cylindrical with a circular base. The central axis of the passage opening 185 is the sixth axis A6. The sealing means 190 are able to prevent the passage of pressurized air through the passage opening 185 when the central part 193 is received in the passage opening 185.

The sealing means 190 are able to allow the central part 193 to translate along the primary direction Z relative to the piston 20.

The sealing means 190 comprise a ring 230, two stem seals 232 and two covers 233. The ring 230 is able to guide the reversing stem 30 in translation along the secondary direction Z'. The ring 230 is made from a synthetic material, such as a polyacetal. The stem seals 232 are able to prevent the passage of compressed air between the upper primary chamber 165 and the lower primary chamber 170 when the central part 193 is received in the passage opening 185.

The stem seals 232 are O-rings, for example made from plastic. The two covers 233 are configured to keep the stem seals 232 and the ring 230 in position. The two covers 233 are fastened to the piston 20. For example, the two covers 233 are screwed to the piston. The two covers 233 are for example made from metal, such as aluminum.

The central part 193 is cylindrical, preferably with a circular base, and its central axis is the sixth axis A6. The central part 193 traverses the piston 20.

The first valve 195 is able to prevent the passage of compressed air from the first secondary chamber 103 toward the first external opening 85, when the first valve 195 is bearing on the first intake seat 220.

The first valve 195 is able to prevent the passage of compressed air between the upper primary chamber 165 and the first discharge opening 235, when the first valve 195 is bearing on the first discharge seat 240.

The first valve 195 is housed in the first secondary chamber 103. The first valve 195 is fastened, for example by screwing, to the first end part 192. The first valve 195 is at least partially made from a ferromagnetic material. For example, the first valve 195 comprises a core made from steel. Preferably, the first valve 195 is at least partially covered with a thermoplastic material. For example, the thermoplastic material is polyurethane.

The second valve 200 is able to prevent the passage of compressed air from the second secondary chamber 153 toward the second external opening 135, when the second valve 200 is bearing on the second intake seat 250.

The second valve 200 is able to prevent the passage of compressed air between the lower primary chamber 170 and the second discharge opening 265, when the second valve 200 is bearing on the second discharge seat 270.

The second valve 200 is housed in the second secondary chamber 153. The second valve 200 is fastened, for example by screwing, to the second end part 194. The second valve 200 is at least partially made from a ferromagnetic material. For example, the second valve 200 comprises a core made from steel. Preferably, the second valve 200 is at least partially covered with a thermoplastic material. For example, the thermoplastic material is polyurethane.

Figure 4:
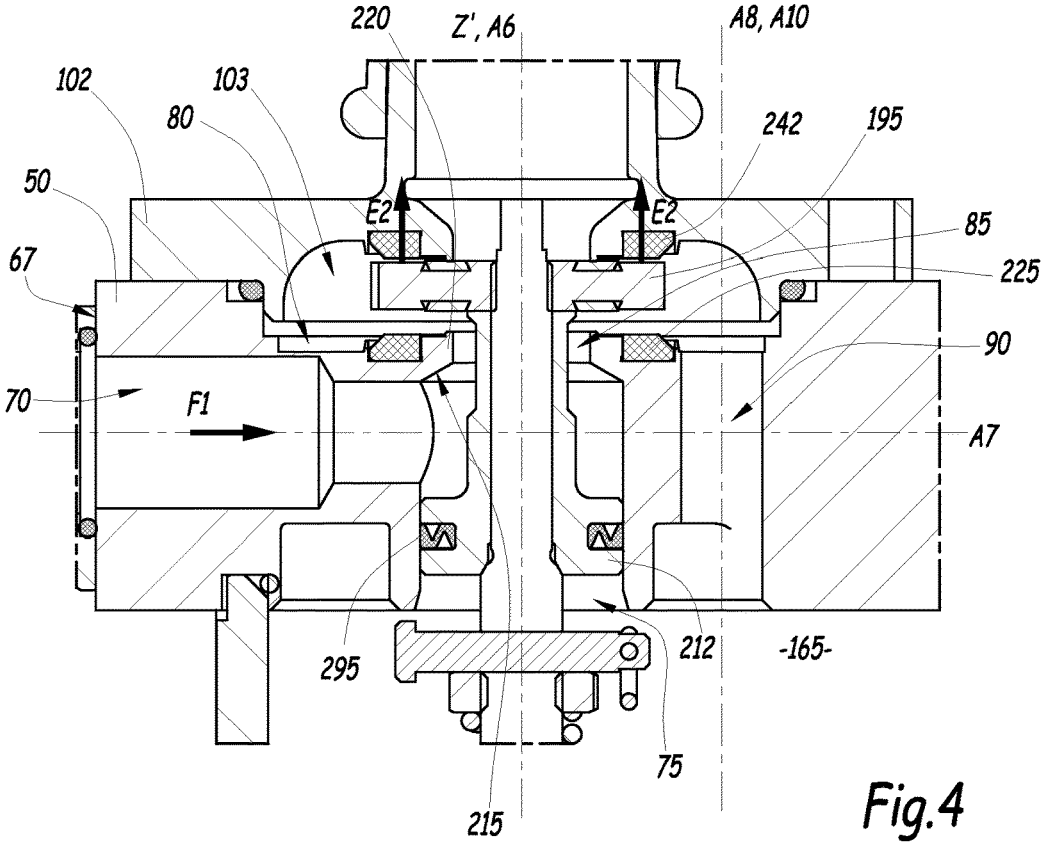
FIG. 4 is an enlarged view of detail IV in FIG. 1.
Figure 5:
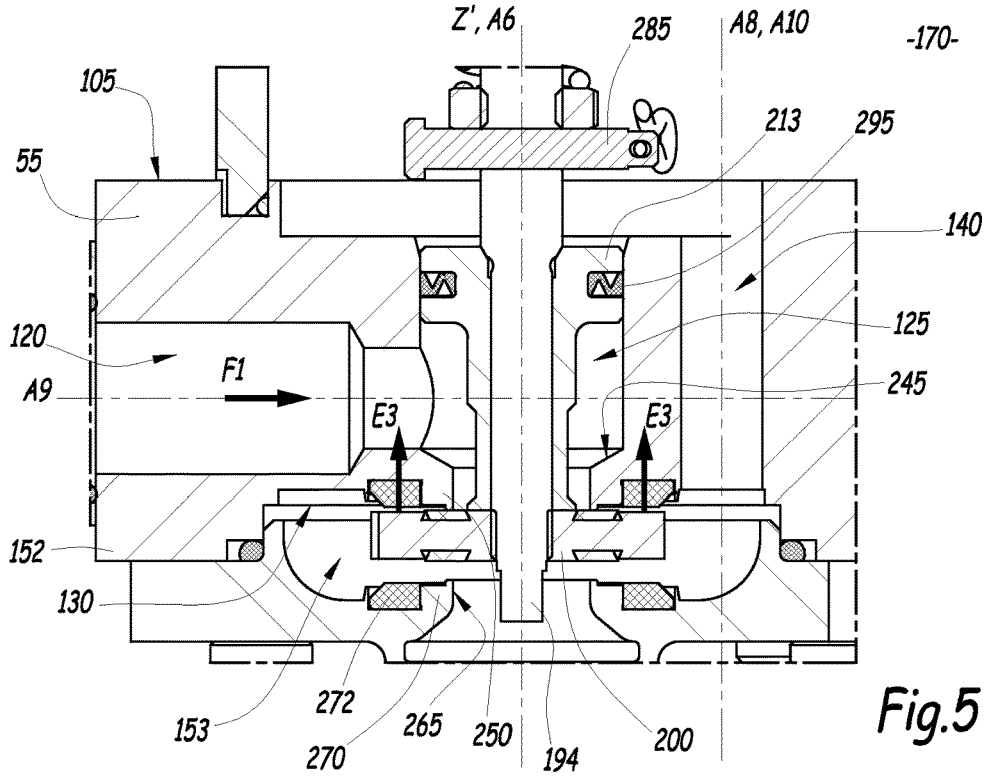
FIG. 5 is an enlarged view of detail V in FIG. 1.
Figure 6:
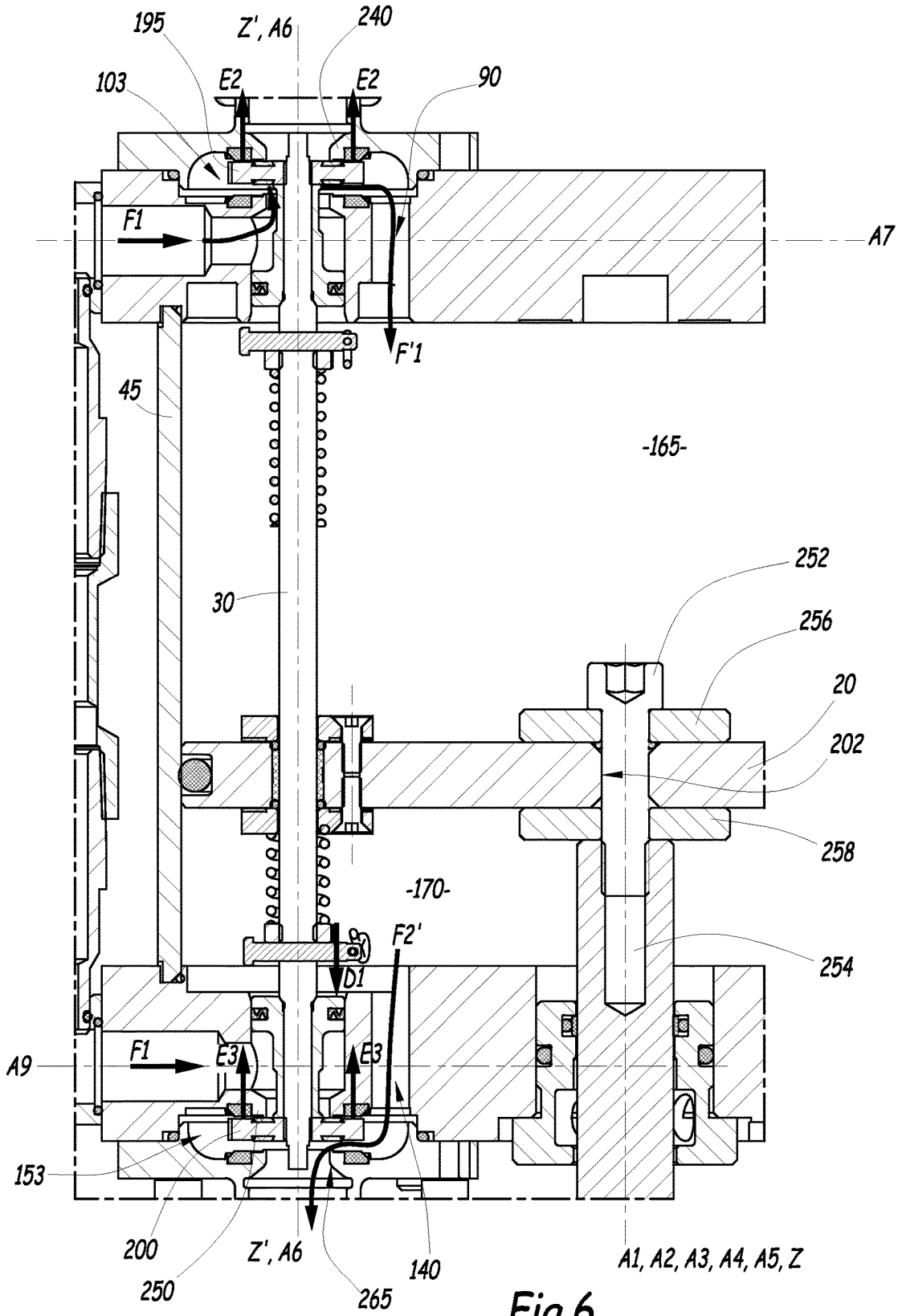
FIG. 6 is an enlarged view of detail VI in FIG. 1, in a first operating configuration of the compressed air motor of FIGS. 1 to 5.
Figure 7:
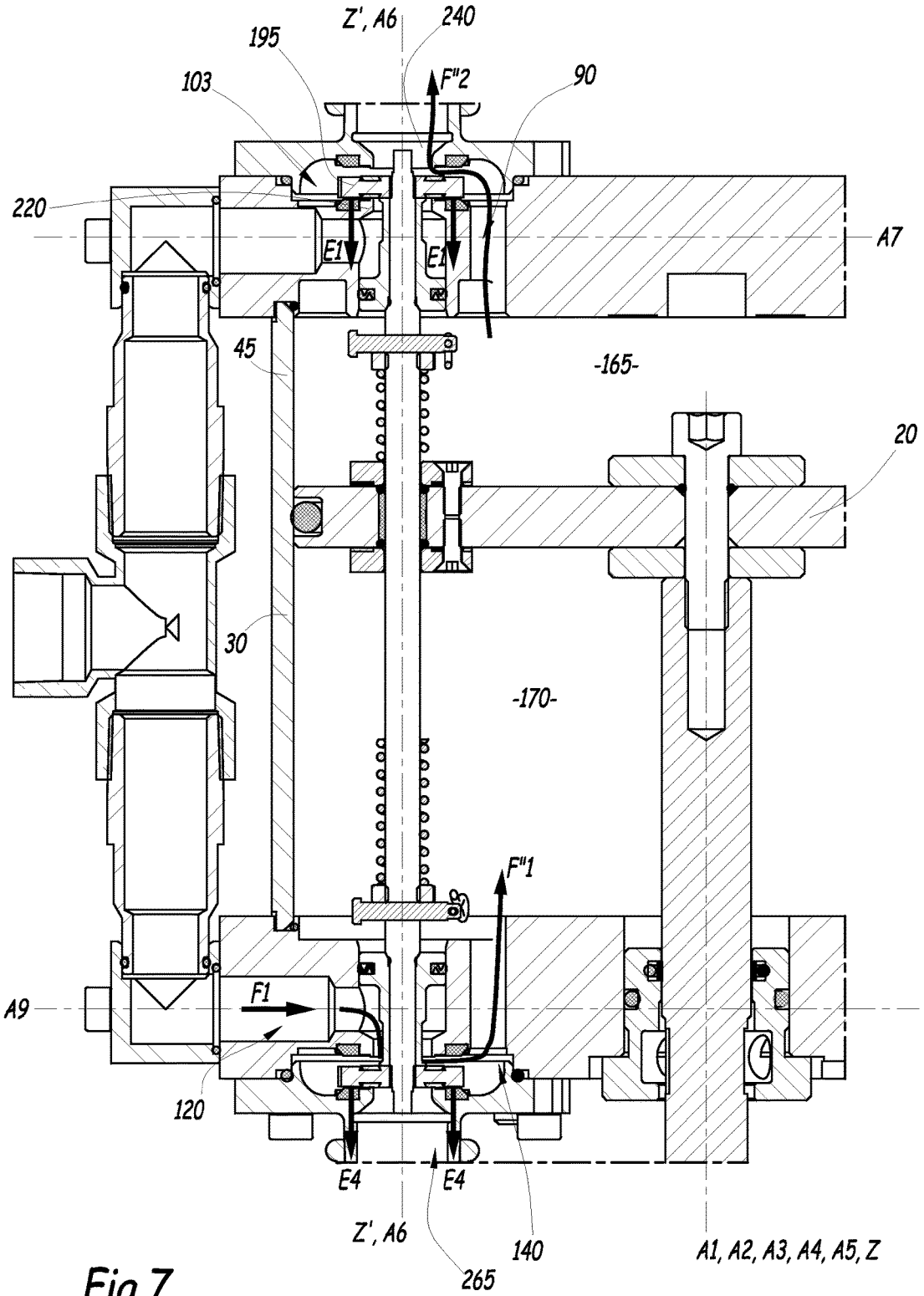
FIG. 7 is a view similar to FIG. 6 when the compressed air motor is in a second operating configuration.

The first moving means 205 are able to cooperate with the piston 20 to move the reversing stem 30 between its second position shown in FIG. 7 and its first position shown in FIGS. 4 to 6.

The first moving means 205 are for example elastic means. The first elastic moving means 205 include a spring 275, a nut 280, a pin 285 and a molders' pin 290.

In an alternative that is not shown, the first elastic moving means 205 comprise a deformable block, in particular made from elastomer.

The second moving means 210 are able to cooperate with the piston 20 to move the reversing stem 30 between its first position and its second position.

The second moving means 210 are for example elastic means. The second elastic moving means 210 are identical to the first elastic moving means 205.

In an alternative that is not shown, the second elastic moving means 205 comprise an elastic block made from elastomer.

The first bearing 212 guides the reversing stem 30 in translation in the internal opening 75, along the sixth axis A6. The first bearing 212 is received in the first internal opening 75. The first bearing 212 is further able to prevent the passage of compressed air between the upper primary chamber 165 and the first supply duct 70. This means that the first bearing 212 slides sealably in the first internal opening 75.

The second bearing 213 guides the reversing stem 30 in translation in the internal opening 125, along the sixth axis A6. The second bearing 213 is received in the second internal opening 125. The second bearing 213 is further able to prevent the passage of compressed air between the lower primary chamber 170 and the second supply duct 120. This means that the second bearing 213 slides sealably in the second internal opening 125.

The first and second bearings 212 and 213 each bear a bearing seal 295.

The first intake seat 220 is arranged in the first cavity 80.

The first intake seat 220 is in the form of a cylindrical crown with a circular base. The axis of the first intake seat 220 is the sixth axis A6.

The first maintaining means 225 are able to exert a first retaining force E1 on the first valve 195. The first maintaining means 225 are able to keep the reversing stem 30 in its second position.

The first retaining force E1 is an attraction force. The first retaining force E1 for example has a value comprised between 2 and 4 decaNewtons (dN).

In practice, the first maintaining means 225 are formed by a first maintaining magnet 225. The first maintaining magnet 225 is made in the form of a cylindrical crown with a circular base. The axis of the first maintaining magnet 225 is the sixth axis A6. The first maintaining magnet 225 surrounds the first intake seat 220 around the sixth axis A6.

The first discharge opening 235 has a cylindrical symmetry around the sixth axis A6. The first discharge seat 240 is arranged in the first end block 102. The first discharge seat 240 is made in the form of a cylindrical crown with a circular base. The axis of the first discharge seat 240 is the sixth axis A6.

The second maintaining means 242 are able to exert a second retaining force E2 on the first valve 195. The second maintaining means 242 are able to keep the reversing stem 30 in its first position.

The second retaining force E2 is an attraction force. The second retaining force E2 for example has a value comprised between 2 and 4 dN.

In practice, the second maintaining means 242 are formed by a second maintaining magnet 242. The second maintaining magnet 242 is made in the form of a cylindrical crown with a circular base. The axis of the second maintaining magnet 242 is the sixth axis A6. The second maintaining magnet 242 is preferably identical to the first maintaining magnet 225. The second maintaining magnet 242 surrounds the first discharge seat 240 around the sixth axis A6.

The second intake seat 250 is arranged in the second cavity 130. The second intake seat 250 is made in the form of a cylindrical crown with a circular base.

The third maintaining means 255 are able to exert a third retaining force E3 on the second valve 200. The third maintaining means 255 are able to keep the reversing stem 30 in its first position.

The third retaining force E3 is an attraction force. The third retaining force E3 for example has a value comprised between 2 and 4 dN.

For example, the third maintaining means 255 are formed by a third maintaining magnet 255. The third maintaining magnet 255 is made in the form of a cylindrical crown with a circular base. The axis of the third maintaining magnet 255 is the sixth axis A6. The third maintaining magnet 255 is preferably identical to the first maintaining magnet 225. The third maintaining magnet 255 surrounds the second intake seat 250 around the sixth axis A6.

The second discharge opening 265 has a cylindrical symmetry around the sixth axis A6.

The second discharge seat 270 is made in the form of a cylindrical crown with a circular base. The axis of the second discharge seat 270 is the sixth axis A6.

The fourth maintaining means 272 are able to exert a fourth retaining force E4 on the second valve 200. The fourth maintaining means 272 are able to keep the reversing stem 30 in its second position.

The fourth retaining force E4 is an attraction force. The fourth retaining force E4 for example has a value comprised between 2 and 4 dN.

In practice, the fourth maintaining means 272 are formed by a fourth maintaining magnet 272.

The fourth maintaining magnet 272 is made in the form of a cylindrical crown with a circular base. The axis of the fourth maintaining magnet 272 is the sixth axis A6. The fourth maintaining magnet 272 is preferably identical to the first maintaining magnet 225. The fourth maintaining magnet 272 surrounds the second discharge seat 270 around the sixth axis A6.

The spring 275 is wound around the reversing stem 30. The spring 275 bears on the nut 280. The nut 280 bears on the pin 285.

The pin 285 is received in a corresponding opening 302 of the reversing stem 30. The pin 285 is configured to serve as a stop for the nut 280 along the reversing stem 30.

The molders' pin 290 traverses the pin 285. The molders' pin 290 prevents the pin 285 from being removed from the corresponding opening of the reversing stem 30.

The operation of the motor 10 will now be described. In FIG. 6, the reversing stem 30 is in its first position.

The first valve 195 is bearing on the first discharge seat 240. The first valve 195 is therefore not bearing on the first intake seat 220.

The second valve 200 is bearing on the second intake seat 250. The second valve 200 is therefore not bearing on the second discharge seat 270.

The compressed air present in the second internal opening 125 exerts a first pressure force Ep1 on the second bearing. The compressed air present in the second chamber exerts a second pressure force Ep2 on the second valve 200.

The compressed air stream F1, coming from the supply tube 35, traverses the first supply duct 70 and penetrates the first secondary chamber 103 via the first outer opening 85 in the form of a secondary air stream F1', which is possible because the first valve 195 is separated from the intake seat 220. The secondary compressed air stream F1' next traverses the first connecting duct 90 to penetrate the upper primary chamber 165.

The compressed air therefore causes the piston 20 to move toward the lower neutral position. The air contained in the lower primary chamber 170 is expelled through the second connecting duct 140, the second secondary chamber 153, the second discharge opening 265 and the silencer 40, in the form of a discharge air stream F2'.

The piston 20 next bears on the second moving means 210. In particular, the piston 20 compresses the spring 275. The spring 275 exerts a first moving force D1 on the reversing stem 30 tending to move the reversing stem 30 toward its second position. When the piston 20 has not yet reached the lower neutral position, the first moving force D1 is lower than the sum of the second retaining force E2, the third retaining force E3, and the first and second pressure forces Ep1 and Ep2. The reversing stem 30 therefore remains in its first position.

When the piston 20 has reached the lower neutral position, the first moving force D1 due to the spring 275 is higher than the sum of the second and third retaining forces E2 and E3 and first and second pressure forces Ep1 and Ep2. The reversing stem 30 is then moved from its first position toward its second position to reach the configuration of FIG. 7.

In FIG. 7, the first valve 195 is bearing on the first intake seat 220. The second valve 200 is therefore bearing on the second discharge seat 270.

The compressed air stream F1 then no longer penetrates the upper primary chamber 165, but the lower primary chamber 170 in the form of a secondary air stream F1". The piston 20 is then set in motion from the low neutral position toward the high neutral position. The air contained in the upper primary chamber 165 escapes through the first connecting duct 90, the first secondary chamber 103, and the first discharge opening 235, in the form of a discharge air stream F2".

When the piston 20 reaches the upper neutral position, the reversing stem 30 is moved from its second position toward its first position, according to a sequence opposite that described above.

The motor 10 is able to command the alternating power supply of the upper primary chamber 165 and the lower primary chamber 170, without using an external device. Furthermore, the motor 10 is highly reliable.

According to a second embodiment that is not shown, the pump 6 includes two pumping stages 8.

The first cylinder head 50 then includes a second through hole for receiving the shaft 25 and a second primary bearing positioned around the shaft 25 and in which this shaft 25 slides when the motor 10 is operating.

The second through hole extends between the first inner face 65 and the first outer face 60.

The second through hole is cylindrical with a circular base. The central axis of the second through hole is the first axis A1.

The second through hole receives the first primary bearing able to allow the shaft 25 to translate along the primary direction Z. The second primary bearing is further capable of preventing the passage of compressed air between the first primary chamber 165 and the outside of the housing 15.

The shaft 25 traverses the first cylinder head 50 and the second cylinder head 55.

Each end of the shaft 25 is coupled to a pumping stage 8.

The operation of the second example is identical to the operation of the first example.

The flow rate of the pump 6 is then increased.

According to a third example embodiment that is not shown, the pump 6 includes a first motor 10 including a first housing 15, a first piston 20, a first valve 195 and a second valve 200, and a second motor 10 including a second housing 15, a second piston 20, a third valve and a fourth valve.

The reversing stem 30 is shared by the first motor 10 and the second motor 10.

The first housing 15 includes a first cylinder head 50 and a second cylinder head 55. The first housing 15 is identical to the housing 15 described in the second example.

The first piston 20 divides the first housing 15 into a first primary chamber 165 and a second primary chamber 170.

The second housing 15 includes a third cylinder head and a fourth cylinder head.

The second piston 20 divides the second housing 15 into a third primary chamber and a fourth primary chamber. The second piston 20 is identical to the first piston 20.

The third cylinder head is identical to the first cylinder head described in the first example.

The fourth cylinder head is identical to the second cylinder head described in the first example. The fourth cylinder head is across from the first cylinder head 165.

The stem 30 extends in the primary direction Z through the second primary chamber 165, the first piston 20, the second primary chamber 170, the first cylinder head 50, the fourth cylinder head, the fourth primary chamber, the second piston, the third primary chamber and the third cylinder head.

The stem 30 bears the first valve 195, the second valve 200, the third valve and the fourth valve.

The stem 30 is movable between a first position and a second position.

The pistons 20 are both mounted on a same shaft 25.

The operation of this third example will now be described.

When the stem 30 is in the first position, the first primary chamber and the third primary chamber are supplied with compressed air. When the stem 30 is in the second position, the second primary chamber and the fourth primary chamber are supplied with compressed air.

The two pistons 20 are actuated simultaneously, and both drive the shaft 25.

The pump 6 is therefore more powerful.

According to a fourth example embodiment, the first moving means 205 and the second moving means 210 are magnetic means.

The first moving means include at least a first moving magnet and a second moving magnet.

The first moving magnet is for example supported by the stem 30. The second moving magnet is for example supported by the piston 20. The first and second moving magnet are able to exert a repulsive magnetic force on one another.

The second moving means include at least a third moving magnet and a fourth moving magnet.

The third moving magnet is for example supported by the stem 30. The fourth moving magnet is for example supported by the piston 20. The third and fourth moving magnet are able to exert a repulsive magnetic force on one another.

The operation of the fourth example is identical to the operation of the first example.

The fabrication of the motor 10 is then simpler.

The features of the embodiments and alternatives described above may be combined to generate new embodiments of the invention.

The invention claimed is:

1. A compressed air motor comprising a piston and a housing, the piston being received in the housing and dividing the housing into two primary chambers of variable volume, the motor comprising:

a first direct supply valve for supplying a first primary chamber of the two primary chambers and a second direct supply valve for supplying a second primary chamber of the two primary chambers, these two valves each being movable relative to at least one respective seat, the first valve and the second valve being mounted on a same stem movable relative to the housing in a direction parallel to the direction of movement of the piston, and the stem being configured to be moved between a first position and a second position by moving means activated by the piston, maintaining means for keeping the stem in at least one of its first and second positions, wherein the first and second valves are made at least partially from a ferromagnetic material, and wherein the maintaining means comprise at least a first maintaining magnet able to exert a first retaining force on the first valve, a second maintaining magnet able to exert a second retaining force on the first valve, a third maintaining magnet able to exert a third retaining force on the second valve and a fourth maintaining magnet able to exert a fourth retaining force on the second valve.

2. The motor according to claim 1, wherein the moving means are activated by the piston when it reaches the upper neutral position or the lower neutral position of its trajectory.

3. The motor according to claim 1, wherein the moving means are elastic means.

4. The motor according to claim 3, wherein the elastic means comprise at least one spring.

5. The motor according to claim 4, wherein the stem bears at least one pin, the spring being wound around the stem and able to exert a force on the pin moving the stem from its second position toward its first position, or vice versa.

6. The motor according to claim 1, wherein the piston is movable relative to the housing along a primary direction and the stem extends in the primary direction through the first primary chamber, the piston and the second primary chamber.

7. The motor according to claims 1, wherein:

the housing comprises a first secondary chamber having a first intake seat and a first discharge seat of the at least one respective seat and a second secondary chamber having a second intake seat and a second discharge seat of the at least one respective seat, the first valve being received in the first secondary chamber and the second valve being received in the second secondary chamber, the first valve bears on the first discharge seat and the second valve bears on the second intake seat, when the stem is in its first position and the first valve is bearing on the first intake seat and the second valve is bearing on the second discharge seat, when the stem is in its second position.

8. The motor according to claim 1, wherein the housing includes at least one cylinder head, and the stem includes at least one bearing sliding sealably in the cylinder head.

9. A pump with alternating movement comprising a motor according to claim 1.

* * * * *